US005724760A

United States Patent [19]

Langner

[11] Patent Number: 5,724,760

[45] Date of Patent: Mar. 10, 1998

[54] TRIGGER SAFETY DEVICE

[76] Inventor: F. Richard Langner, P.O. Box 14706, Scottsdale, Ariz. 85267

[21] Appl. No.: 823,372

[22] Filed: Mar. 24, 1997

[51] Int. Cl.[6] ..... F41A 17/54

[52] U.S. Cl. ..... 42/70.07; 42/70.11

[58] Field of Search ..... 42/70.07, 70.11, 42/70.06; 70/203

[56] References Cited

U.S. PATENT DOCUMENTS

| | | | |
|---|---|---|---|
| 3,022,596 | 2/1962 | Cannon | 42/70.06 |
| 3,352,047 | 11/1967 | McDonnell | 42/70.07 |
| 3,713,239 | 1/1973 | Sperling | 42/70.07 |
| 3,732,641 | 5/1973 | Adajian | 42/70.07 |
| 4,198,026 | 4/1980 | Capolupo | 42/70.11 |
| 4,945,665 | 8/1990 | Nelson | 42/70.07 |
| 5,024,017 | 6/1991 | Nishioka | 42/70.07 |
| 5,025,582 | 6/1991 | Mote, Sr. | 42/70.06 |
| 5,033,218 | 7/1991 | Nelson | 42/70.07 |
| 5,048,212 | 9/1991 | Mossberg | 42/70.11 |
| 5,371,965 | 12/1994 | Nelson | 42/70.07 |
| 5,579,923 | 12/1996 | Hemmerlein | 42/70.11 |

FOREIGN PATENT DOCUMENTS

| | | | |
|---|---|---|---|
| 20813 | 1/1883 | Germany | 42/70.06 |

*Primary Examiner*—Stephen M. Johnson
*Attorney, Agent, or Firm*—LaValle D. Ptak

[57] ABSTRACT

A trigger safety lock for guns comprises a rigid plug, typically made of aluminum or rigid plastic, designed with a central portion configured to frictionally fit into the space between the rear of the trigger of the gun and the trigger guard. The plug prevents depression of the trigger to fire the gun. The plug has an ejector extension on one side of the central portion, which extends laterally beyond the trigger guard for engagement by a user to force the plug out of the space behind the trigger. The dimensions of the extension are such that it freely passes through the space. The ejector extension has a hole through it for receiving a locking device to positively lock the trigger when the gun is in storage. A flange on the opposite side of the central portion of the plug overlaps at least part of the trigger or trigger guard and engages the trigger or trigger guard when the central portion is located in the space behind the trigger.

14 Claims, 2 Drawing Sheets

TRIGGER SAFETY DEVICE

BACKGROUND

Hand guns are in widespread use both by law enforcement agencies and by people who carry guns for their own protection. Inadvertent discharge of such hand guns frequently occurs, through mishandling of a gun in a casual manner by someone who is unaware that the gun is in firing condition (chamber loaded). Devices have been designed to lock the trigger of a gun against inadvertent actuation. Such devices include safety locks built into the guns, as well as slide buttons in the rear of the trigger guard. Some devices employ locks with keys, and others are cumbersome and interfere with the holstering of the gun.

Another function of trigger blocks or trigger locks is to prevent intentional misuse or unauthorized use of a hand gun. Blocks of this type are particularly desirable for guns carried by police officers. There is a danger of a gun being snatched from a policeman's holster and used against him and others, with tragic results. Police officers periodically are killed with their own guns.

A trigger safety device designed particularly for blocking the trigger operation of a police revolver is disclosed in the United States patent to Sperling U.S. Pat. No. 3,713,239. This device is a mechanical trigger block in the form of a plug made of resilient material, which is wedged behind the trigger between it and the trigger guard. The material is a medium-soft rubber or plastic material. When the plug is in place, it is compressed; so that it remains firmly in position. When the gun is to be used, it is necessary for the user to firmly push the plug out from behind the trigger to remove it; so that the gun can be used. The resilient nature of the plug and the fact that it must be compressed to hold it in place causes removal of the plug, in an emergency situation, to be subject to potential failure. In addition, to ensure full complete removal of the plug, the index finger of the user must be pressed into the space behind the trigger. Modern firearms, in many cases, do not have a large enough space behind the trigger to fit one's finger. After the plug is removed, the finger then must be withdrawn and placed in front of the trigger to fire the gun. This two-step process, even though quickly performed, potentially can take excessive time in a dangerous or emergency situation.

Another safety lock, placed behind the trigger of a hand gun between the trigger and the trigger guard, is disclosed in the U.S. patent to Adajian U.S. Pat. No. 3,732,641. This patent presents some of the same problems as the device of the Sperling patent discussed above. In addition, the Adajian safety lock is complex and requires multiple parts and springs for its operation. The trigger lock of Adajian requires that the tip of the nail of the trigger finger engages an exposed front face of a spring-loaded latch to move it backward to allow the lock to "drop free" away from the hand gun. To do this, the hand gun would need to be turned on its side; so that the side opposite the one being engaged to release the latch faces downwardly. This is not a positive ejection of the device; and the steps needed in order to release the device consume valuable time. In addition, because of the nature of the spring loaded latch, it is possible, in an emergency situation, to fail to release the latch in time to ready the pistol for use.

Three other patents which are directed to quick release gun trigger safety devices are the patents to Nelson U.S. Pat. Nos. 4,945,665; 5,033,218; and 5,371,965. All of these patents are directed to devices which require the trigger first to be pulled back against the trigger guard. The safety device (in the form of a plug) then goes in front of the trigger to prevent operation of the firearm. The plugs are removed by pushing them out of the space between the trigger and the trigger guard. With the devices of these patents, however, the trigger then must move forward after release of the plug in order to cock the gun for firing. Consequently, rapid removal of the device, leaving the gun ready to fire, is not immediately present with the devices of these three patents.

A different approach is shown in the U.S. patent to Cannon U.S. Pat. No. 3,022,596. This patent is simply a cover which extends over the entire trigger guard to prevent use of the hand gun while the cover is in place.

It is desirable to provide a simple and inexpensive device for providing a trigger block safety, and an optional trigger lock of a hand gun, which is capable of rapid and positive removal when use of the hand gun is desired.

SUMMARY OF THE INVENTION

It is an object of this invention to provide an improved trigger block safety for a gun.

It is a further object of this invention to provide an improved trigger block safety for a gun which quickly and effectively may be removed to ready the gun for firing.

It is an additional object of this invention to provide an improved trigger block safety device which does not interfere with the normal handling and storage of a gun.

It is a further object of this invention to provide an improved unitary trigger block safety device for a hand gun having an ejector extension on it for facilitating rapid and positive removal of the device when the gun is to be used.

In accordance with a preferred embodiment of the invention, a trigger safety lock for guns is constructed in the form of a rigid plug. The plug has a central portion which is configured to frictionally fit into the open space between the rear of the trigger of the gun and the trigger guard. This prevents depression of the trigger whenever the plug is in place. An ejector extension is formed on one side of the central portion of the plug; and it extends laterally at right angles to the plane of the trigger guard and beyond the trigger guard for engagement by a user to force or pop the plug out of the space when the gun is to be readied for firing. The extension freely passes through the space between the rear of the trigger and the trigger guard. A flange is placed on the opposite side of the central portion of the plug to overlap at least part of the trigger or the trigger guard when the central portion of the plug is located in the space behind the trigger.

DETAILED DESCRIPTION

Figure 1:
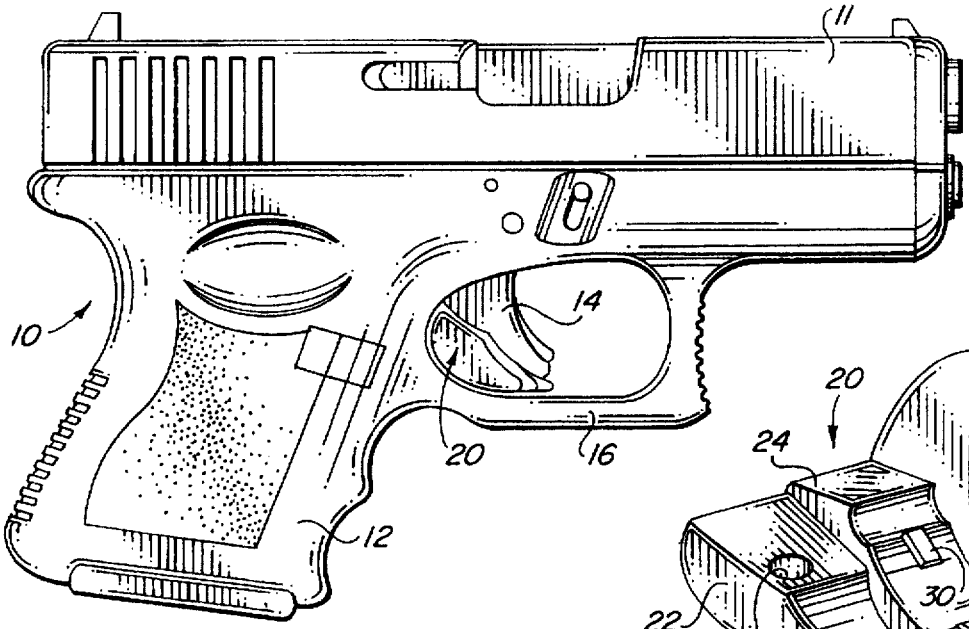
FIG. 1 is a side view of a hand gun with a preferred embodiment of the invention shown in its position of use.
Figure 2:
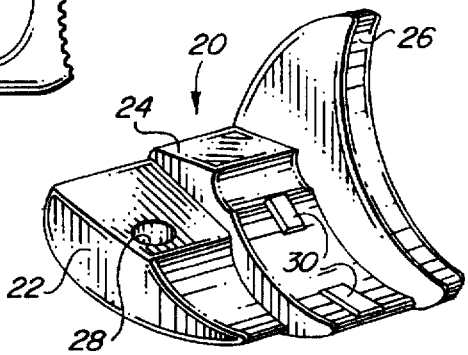
FIG. 2 is a front perspective view of the preferred embodiment of the invention.
Figure 3:
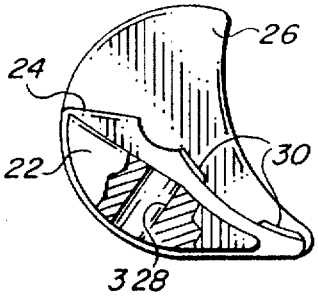
FIG. 3 is a partially cut away side view of the embodiment shown in FIG. 2.

Reference now should be made to the drawings, in which the same reference numbers are used throughout the different figures to designate the same components. FIG. 1 is a side view of a hand gun 10 of a type commonly used by law enforcement officers. The hand gun 10 comprises a barrel portion 11 and a handgrip portion 12, with a trigger 14 enclosed by a trigger guard 16. The hand gun which is depicted in FIG. 1 is a semi-automatic pistol; and various other features of the hand gun, which are not important to an understanding of the present invention, will not be described here. As is apparent from an examination of FIG. 1, the trigger 14, in its released or ready state, is spaced from both the rear and front of the trigger guard 16. The space in front of the trigger 14 permits insertion of the index finger of the user; and the space behind the trigger 14 allows the trigger to be pulled back to effect firing of the gun.

Guns 10 of the type disclosed in FIG. 1, particularly those used by law enforcement officers, are designed without conventional safetys in order to facilitate the instant use of the weapon. These types of hand guns primarily are designed to be carried in a holster which covers the trigger and trigger guard, preventing accidental discharge of the hand gun. This protection obviously only is afforded while the weapon is in the holster. The process of holstering and drawing the weapon from the holster creates the possibility of an accidental discharge. In fact, such discharges do occur if the hand gun of the type shown in FIG. 1 is carried in "condition 1" (chamber loaded). Hand guns 10 of the type shown in FIG. 1, however, frequently are carried by law enforcement officers in the "condition 1" or ready state of operation; so that they are immediately available for firing in the event of an emergency situation. In this condition, the gun 10 is immediately capable of being fired whenever the trigger 14 is pulled to the rear of the trigger guard 16 toward the handgrip 12 of the gun.

The preferred embodiment of the invention is designed to prevent accidental discharge of a weapon when it is in its "condition 1" state. To prevent accidental discharge of the hand gun of FIG. 10, the preferred embodiment of the invention comprises a trigger block in the form of a rigid unitary plug 20, which consists of three portions, namely a central portion 24, with an ejector extension 22 on one side and a trigger-covering flange 26 on the other side. These various parts of the trigger block are shown in FIG. 2 through 8. The ejector 22 has a hole 28 formed through it, as shown most clearly in FIG. 3. The central portion 24 has a pair of slightly raised tabs or projections 30 on it, which are located directly behind the trigger 14 when the device is inserted in place as shown in FIGS. 1, 10, 11 and 12. The flange 26 overlies the trigger 14 and a portion of the trigger guard 16, as shown most clearly in FIG. 11, when the trigger block 20 is inserted into place as shown most clearly in FIGS. 1, 11 and 12.

Figure 12:
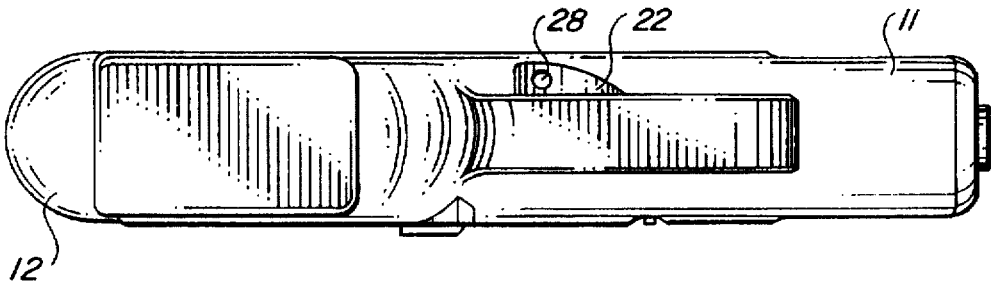
FIG. 12 is a bottom view of the hand gun shown in FIGS. 1 and 11 illustrating a feature of the invention.

As is apparent from an examination of FIG. 12, when the trigger block 20 is in place, all of the portions 22, 24 and 26 occupy an area or dimension laterally of the gun which is less than the width of the barrel portion 11 of the gun. Consequently, when the gun 10 is placed into a holster or is carried in a more unconventional manner, such as in a "fanny pack", purse, behind the back, or slipped into pants under a belt, etc., the trigger block 20 is free of any interference, since the width of the barrel 11 is greater than the transverse width of the trigger block 20 including all of its parts 22, 24 and 26.

When the trigger block 20 is in place, the trigger 14 is prevented from being pulled back or depressed, since the central portion 24 of the trigger block 20 forms a rigid block between the trigger guard 16 and the rear of the trigger 14. Thus, it is impossible to fire the pistol 10 when the trigger block 20 is in place. A brand of hand gun which is highly popular with law enforcement officers is the GLOCK® hand gun. This type of hand gun has a shallow groove at the rear of the trigger 14 along its length. The slight projections 30 fit into this groove when the trigger block 20 is used with a hand gun of this manufacture.

Of course, the triggers 14 of hand guns or pistols of other manufacturers may not have such a groove. Consequently, the projections 30 are optional and may not be used in all configurations of the trigger block which is shown in the various figures of the drawing. It should be noted that the central portion 24 of the trigger block is designed to fit within the recess behind the trigger 14 and the rear of the trigger guard 16 of a pistol, and therefore is configured to the particular shape of that recess for whatever pistol is being protected by the trigger block device. Trigger tension is used to hold the block 20 in place. For some guns, the trigger 14 is urged slighly forward to gently but firmal wedge the central portoin 24 into place. Similarly, the ejector 22 is designed to be of a smaller cross-sectional dimension (taken in the vertical plane of FIGS. 3 and 4 for example) than the portion 24; so that the ejector extension 22 easily slips behind and through the space between the trigger 14 and the trigger guard 16 of the pistol when the trigger block 20 is removed.

Figure 11:
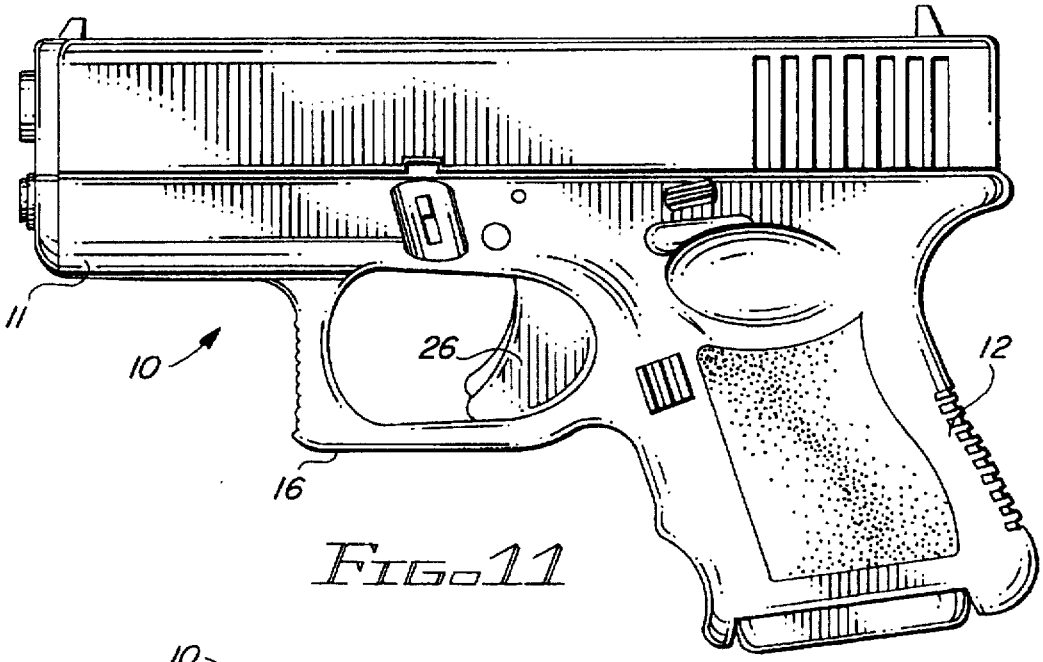
FIG. 11 is a side view of the reverse side of the hand gun of FIG. 1 with the preferred embodiment of the invention in place in its operating position.

When the trigger block is in place, as shown in FIGS. 1, 11 and 12, the only portion which sticks out beyond the trigger guard 16 is the end of the ejector extension 22, as clearly shown in FIG. 12. Whenever the user of the gun desires to fire the gun, after it has been withdrawn from its holster or other storage position, a sharp tap or push on the exposed portion of the ejector extension 22, using the index finger, causes the trigger block rapidly to pop out of place. Once the friction fit between the rear of the trigger and the trigger guard 16 by the central portion of the trigger block 20 is overcome, the device rapidly is pushed away, flies away from, or pops out of position, when force is applied to the exposed end of the ejector extension 22. The gun 10 then immediately is available for firing. This movement takes place nearly instantaneously as the gun user places the index finger in position, first pressing or tapping on the ejector 22 and then in firing position in front of the trigger 14.

Because the trigger block 20 is made of rigid material, such as hard plastic or aluminum, it is not necessary to overcome a rubber-like resiliency, requiring substantial pressure, to remove the trigger block from its location behind the trigger 14. The central portion 24 (with or without the projections 30) is designed to cause a snug fit between the rear of the trigger 14 and the trigger guard 20 with sufficient force to hold the block 20 in place as the pistol is placed into or withdrawn from a holster or other storage position. This friction fit, however, is designed to be readily overcome through moderate pressure or a sharp tap on the end of the ejector 22 to remove the safety block 20 plug rapidly from behind the trigger 14 when desired.

Figure 4:
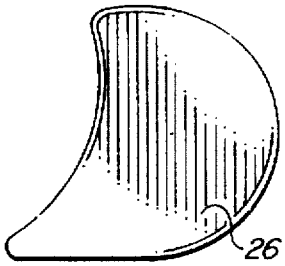
FIG. 4 is a side view of the opposite side of the device shown in FIG. 3.
Figure 6:
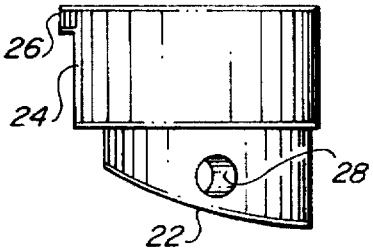
FIG. 6 is a bottom view of the device shown in FIG. 2.
Figure 5:
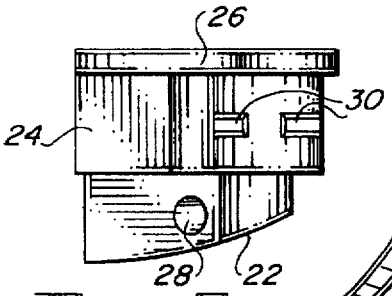
FIG. 5 is a top view of the device shown in FIG. 6.
Figure 7:
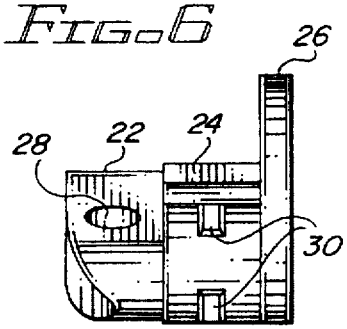
FIG. 7 is a front view of the device shown in FIG. 2.

As is readily apparent from an examination of FIGS. 4 and 11, to place the trigger block 20 into the position shown in FIGS. 1, 11 and 12, the ejector extension 22 first is inserted from the opposite side shown in FIG. 1 through the space behind the trigger 14 to frictionally wedge or secure the central portion 24 into place, as described above. This is ensured by pressing the flange 26 firmly into place until it rests either against the trigger 14 or the rear part of the trigger guard 16 to cause the trigger block 20 to be positioned as shown in FIG. 12. Thus, a positive insertion of the trigger block 20 to precisely the position required to cause it effectively to block operation of the trigger 14 is effected by pushing on the flange 26 until it engages the trigger 14 and/or the rear part of the trigger guard 16, as described.

Figure 9:
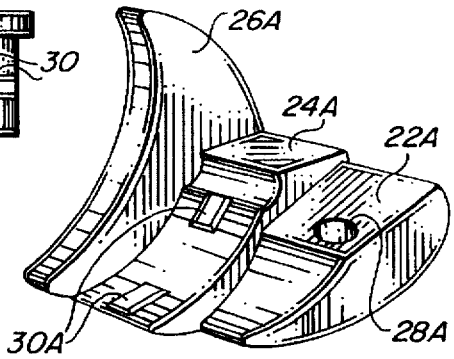
FIG. 9 is a mirror image version of the device shown in FIG. 2, for use by left-handed persons.
Figure 8:
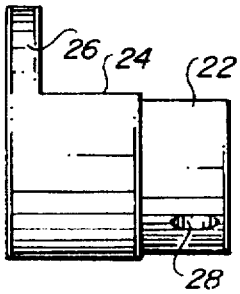
FIG. 8 is a rear view of the device shown in FIG. 2.

The device illustrated in FIGS. 1 through 8 and 10 through 12 is made for a right-handed shooter; so that it is inserted through the left-hand side of the gun. The device then is removed by pressure of the right index finger of the user onto the exposed end of the ejector extension 22, as described above. FIG. 9 shows a left-handed version of the device. The device shown in FIG. 9 essentially is a mirror image of the one shown in FIG. 2, and is inserted through the right-hand side of the gun to cause the ejector extension 22A to extend from the side opposite to the side shown in FIG. 12. In all other respects, the device of FIG. 9 operates in the same manner as the device described above in conjunction with the other figures of the drawing. Since the parts of the device of FIG. 9 are mirror images of those in FIG. 2, they are designated as 22A, 24A, 26A, 28A and 30A, respectively.

Figure 10:
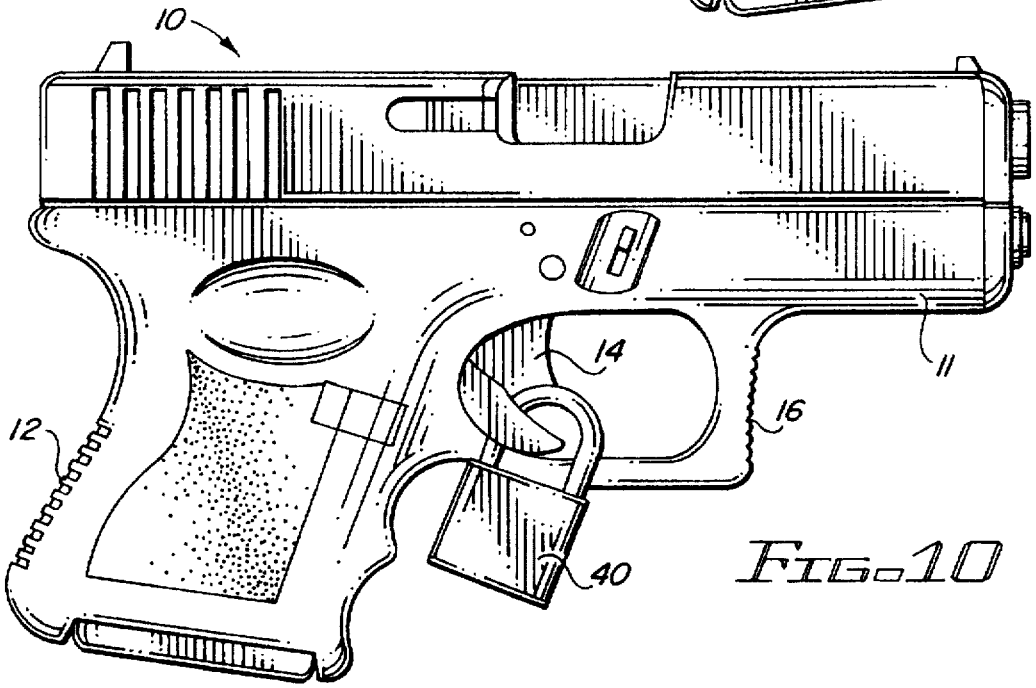
FIG. 10 is a side view of a hand gun with the preferred embodiment of the invention showing a padlock in place in one mode of operation of the invention.

Another feature of the invention is illustrated in FIG. 10. FIG. 10 shows a padlock with the hasp extended through the hole 28 (or 28A of FIG. 9) and locked in place to prevent removal of the trigger block 20 from the pistol 10 so long as the padlock 40 is locked and secured in the positon shown in FIG. 10. Thus, this additional feature of the trigger block 20 prevents both accidental and intentional removal of the trigger block, since the flange 26 on the opposite side prevents removal from that side and the padlock 40 prevents removal from the right-hand side, as shown in FIG. 1. With this type of securing device, the gun 10 may be stored safely between uses with the owner secure in the knowledge that it cannot be discharged accidentally.

Another important function of the invention which has been shown and described is to prevent unauthorized use of the gun. Law enforcement officers periodically are killed with their own guns. When a pistol has a trigger block 20 in place, the trigger block 20 can help prevent such incidents, due to the fact that persons not familiar with the trigger block 20 will not realize that it is in place blocking the trigger. Such persons also will not know how to eject the block 20 if they previously have not encountered its use. Consequently, the trigger block 20 is especially effective in situations where a criminal may be struggling a law enforcement officer and takes the gun away from him or removes it from his holster. Because of the high stress and little time to determine what is wrong (why the trigger won't pull), the attempted firing of the gun at the officer may be thwarted. A law enforcement version of the trigger block 20 is manufactured from black anodized aluminum or black molded plastic without any markings; so that it blends in with the gun and the coloring of the gun (typically, black).

The foregoing description of the preferred embodiment of the invention is to be considered as illustrative and not as limiting. Various changes and modifications will occur to those skilled in the art for performing substantially the same function, in substantially the same way, to achieve substantially the same results without departing from the true scope of the invention as defined in the appended claims.

What is claimed is:

1. A trigger safety lock for guns having a trigger guard and a trigger therein with a space between the rear of the trigger and the trigger guard, said safety lock including in combination:

a rigid plug having at least a central portion configured to frictionally fit into said space between the rear of said trigger and said trigger guard to prevent depression of said trigger to fire the gun, said central portion of said rigid plug having first and second opposite sides;

a stepped-down ejector extension on the first side of said central portion and extending laterally therefrom beyond said trigger guard when said plug is in said space for engagement by a user of the gun to force said plug laterally out of said space, said ejector extension dimensioned with a thickness less than that of said central portion to permit said ejector extension to freely pass through said space; and a flange on the second side of said central portion of said rigid plug overlapping at least part of one of said trigger and said trigger guard in engagement therewith with said central portion of said rigid plug located in said space.

2. The combination according to claim 1 wherein said central portion, said ejector extension, and said flange of said rigid plug comprise a single unitary structure.

3. The combination according to claim 1 wherein said rigid plug is a single unitary structure made of molded plastic.

4. The combination according to claim 3 wherein said central portion has a trigger engaging surface dimensioned to substantially correspond with the dimensions of the rear of said trigger, with said trigger engaging surface having at least one outwardly extending projection thereon.

5. The combination according to claim 1 wherein said rigid plug, including said central portion, said ejector extension, and said flange is made of metal.

6. The combination according to claim 5 wherein said metal is aluminum.

7. The combination according to claim 6 wherein said central portion, said ejector extension, and said flange of said rigid plug comprise a single unitary structure.

8. The combination according to claim 1 wherein said ejector extension has a hole therethrough.

9. The combination according to claim 8 wherein the portion of said ejector extension with said hole therethrough extends beyond said trigger guard when said plug is in said space.

10. The combination according to claim 1 wherein said central portion has a trigger engaging surface dimensioned to substantially correspond with the dimensions of the rear of said trigger, with said trigger engaging surface having at least one outwardly extending projection thereon.

11. A trigger safety lock for guns having a trigger guard and a trigger therein with a space between the rear of the trigger and the trigger guard, said safety lock including in combination:

a rigid plug having at least a central portion configured to frictionally fit into said space between the rear of said trigger and said trigger guard to prevent depression of said trigger to fire the gun, said central portion of said rigid plug having first and second opposite sides and having a trigger engaging surface dimensioned to substantially correspond with the dimensions of the rear of said trigger, with said trigger engaging surface having at least one outwardly extending projection thereon;

an ejector extension on the first side of said central portion with a portion extending laterally therefrom beyond said trigger guard when said plug is in said space for engagement by a user of the gun to force said plug out of said space, said laterally extending portion having a hole therethrough, said ejector extension dimensioned to freely pass through said space;

a flange on the second side of the central portion of said rigid plug overlapping at least part of one of said trigger and said trigger guard in engagement therewith with said central portion of said rigid plug located in said space; and wherein said central portion, said ejector extension, and said flange of said rigid plug comprise a single unitary structure.

12. The combination according to claim 11 wherein said rigid plug is made of molded plastic.

13. The combination according to claim 11 wherein said rigid plug, including said central portion, said ejector extension, and said flange is made of metal.

14. The combination according to claim 13 wherein said metal is aluminum.

* * * * *